US011058160B2

(12) United States Patent
Kwak

(10) Patent No.: US 11,058,160 B2
(45) Date of Patent: Jul. 13, 2021

(54) CONVERTIBLE VEST AND JACKET SYSTEM

(71) Applicant: NIKE, Inc., Beaverton, OR (US)

(72) Inventor: Michelle Jeong-Eun Kwak, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 25 days.

(21) Appl. No.: 16/547,897

(22) Filed: Aug. 22, 2019

(65) Prior Publication Data

US 2020/0146372 A1 May 14, 2020

Related U.S. Application Data

(60) Provisional application No. 62/758,043, filed on Nov. 9, 2018.

(51) Int. Cl.
*A41D 15/00* (2006.01)
*A41D 3/02* (2006.01)
(Continued)

(52) U.S. Cl.
CPC ..... *A41D 15/00* (2013.01); *A41D 3/02* (2013.01); *A41D 27/10* (2013.01); *A41D 27/20* (2013.01);
(Continued)

(58) Field of Classification Search
CPC ..... A41D 15/00; A41D 3/02; A41D 27/10; A41D 27/20; A41D 2300/322;
(Continued)

(56) References Cited

U.S. PATENT DOCUMENTS 1,365,904 A * 1/1921 Forsyth ..... A41D 27/10 2/94
2,073,711 A * 3/1937 Robinson ..... A41D 27/10 2/126
(Continued)

FOREIGN PATENT DOCUMENTS

CN 106666873 A 5/2017
FR 2474285 A1 7/1981
(Continued)

OTHER PUBLICATIONS

"Tropiformer," SCOTTeVEST, scottevest.com, May 5, 2018. https://web.archive.org/web/20180505162414/https://www.scottevest.com/shop/mens-jackets/mens-lightweight-jacket/tropiformer-jacket-men.shtml.
(Continued)

*Primary Examiner* — Katherine M Moran
*Assistant Examiner* — Haley A Smith
(74) *Attorney, Agent, or Firm* — Shook, Hardy and Bacon LLP

(57) ABSTRACT

Aspects herein are directed to a garment that can be converted from a vest to a jacket and vice versa. The garment comprises sleeves having a proximal end and a distal end. A posterior portion of the proximal end of each sleeve is permanently affixed to a torso portion of the garment adjacent to a posterior edge of a sleeve opening of the garment. And an anterior portion of the proximal end of each sleeve is releasably coupled to the torso portion adjacent to an anterior edge of the sleeve opening of the garment. The garment may additionally comprise a pocket located on an inner-facing surface of a back aspect of a torso portion of the garment. When in the form of a vest, the anterior portion of the proximal end of each sleeve may be de-coupled from the
(Continued)

sleeve openings, and the sleeves may be stowed within the pocket.

15 Claims, 13 Drawing Sheets

(51) Int. Cl.
*A41D 27/20* (2006.01)
*A41D 27/10* (2006.01)

(52) U.S. Cl.
CPC .. *A41D 2300/322* (2013.01); *A41D 2400/422* (2013.01)

(58) Field of Classification Search
CPC .... A41D 2400/422; A41D 3/03; A41D 27/28; A41D 27/285; A41D 27/204; A41D 27/201
USPC ..... 2/94
See application file for complete search history.

(56) References Cited

U.S. PATENT DOCUMENTS

| | | | | |
|---|---|---|---|---|
| 2,122,873 | A | 7/1938 | Shuster | |
| 4,006,495 | A * | 2/1977 | Jones | A41D 3/00 2/93 |
| 4,122,553 | A | 10/1978 | Pitkanen | |
| 4,217,663 | A | 8/1980 | Goldberg et al. | |
| 4,261,059 | A | 4/1981 | Spitz | |
| 4,302,850 | A * | 12/1981 | Maeshima | A41D 27/10 2/102 |
| 4,475,252 | A | 10/1984 | Peyser et al. | |
| 4,554,682 | A | 11/1985 | Hillquist | |
| 4,569,089 | A * | 2/1986 | Nesse | A41D 3/00 2/102 |
| 5,077,838 | A | 1/1992 | Senser | |
| 6,253,379 | B1 * | 2/2001 | Collier | A41D 3/02 2/108 |
| 6,298,485 | B1 | 10/2001 | Heller | |
| 7,392,549 | B1 | 7/2008 | Barber | |
| 8,341,769 | B2 | 1/2013 | Fayle et al. | |
| 2016/0120241 | A1 * | 5/2016 | Rose | A41D 27/10 2/269 |
| 2017/0135421 | A1 | 5/2017 | Treyger | |
| 2019/0380403 | A1 * | 12/2019 | Schwirtz | A41D 15/002 |

FOREIGN PATENT DOCUMENTS

| | | | | |
|---|---|---|---|---|
| JP | 2005133269 | A | 5/2005 | |
| JP | 2017089065 | A * | 5/2017 | |
| KR | 20040096921 | A | 11/2004 | |
| KR | 20110001871 | U * | 2/2011 | A44B 18/0073 |
| KR | 20110001871 | U | 2/2011 | |
| KR | 200466343 | Y1 * | 4/2013 | A41D 27/10 |

OTHER PUBLICATIONS

"Rocky BroadHead Waterproof Jacket," Rocky®, rockyboots.com, Oct. 27, 2017. https://web.archive.org/web/20171027182412/https://www.rockyboots.com/sale/rocky-broadhead-waterproof-jacket/HW00007.html.

"Multipurpose Travel Jacket Converts to a Carrying Bag," Supplier Community, supplier.community, Jul. 18, 2018. https://web.archive.org/web/20180718014610/https://supplier.community/multipurpose-travel-jacket-converts-to-a-carrying-bag/.

"Salomon XT Zip-Off Jacket—Men's," REI Coop, rei.com, Item #834653, Jan. 25, 2013. https:// web.archive.org/web/20130125191857/https://www.rei.com/product/834653/salomon-xt-zip-off-jacket-mens.

"PA323—Unisex detachable sleeve softshell jacket," European Catalog, europeancatalog.eu, accessed: Jul. 2018. http://www.europeancatalog.eu/detachable -sleeve-softshell-jacket-proact.html.

"4-in-1 Waterproof Jacket with Zip-off Sleeves," Sportsman's Guide®, sportsmansguide.com, accessed: Jul. 2018. https://www.sportsmansguide.com/product/i ndex/4-in-1-waterproof-jacket-with-zip-off-sleeves?a=525097.

International Search Report and Written Opinion dated Oct. 21, 2019 in International Patent Application No. PCT/US2019/048468, 23 pages.

* cited by examiner

CONVERTIBLE VEST AND JACKET SYSTEM

CROSS-REFERENCE TO RELATED APPLICATIONS

This application, assigned U.S. application Ser. No. 16/547,897, filed Aug. 22, 2019, and entitled "Convertible Vest and Jacket System," claims the benefit of priority of U.S. Prov. App. No. 62/758,043, filed Nov. 9, 2018, and entitled "Convertible Vest and Jacket System." The entirety of the aforementioned patent application is incorporated by reference herein.

TECHNICAL FIELD

Aspects herein are directed to a jacket that can be converted into a vest and vice versa.

BACKGROUND

Traditional garments that can be converted from a vest to a jacket and vice versa, typically require a wearer to awkwardly manipulate his or her arms out of the sleeves when converting the jacket to a vest. Moreover, once the sleeves are doffed, time-consuming manipulations, such as rolling up the sleeves must occur prior to stowing the sleeves. And storage pockets for the doffed sleeves are often positioned in locations on the vest that are uncomfortable to the wearer, affect wearer movements, and/or negatively impact the aesthetics of the vest.

BRIEF DESCRIPTION OF THE DRAWINGS

Examples of aspects herein are described in detail below with reference to the attached drawing figures, wherein.

DETAILED DESCRIPTION

Figure 1:
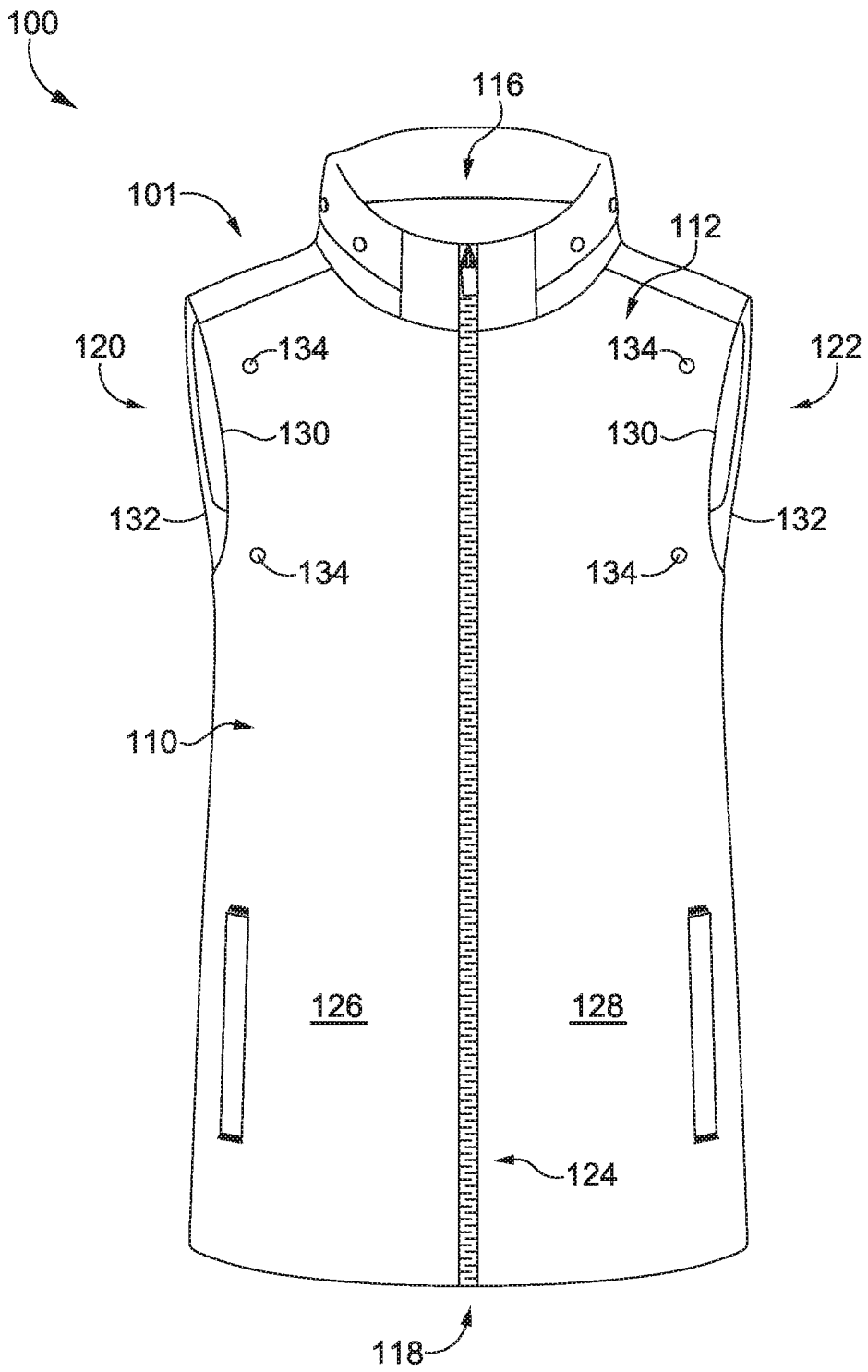
FIG. 1 illustrates a front view of an example convertible vest/jacket in a first vest state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a convertible vest and jacket system. As used herein, the term "garment" may be used to more generally describe the convertible vest/jacket system. The garment comprises features that enable a wearer to easily transition from the vest to the jacket and vice versa. Moreover, the garment described herein provides a convenient storage system for the doffed sleeves such that the stowed sleeves do not impact wearer movements and do not negatively impact the aesthetics of the garment.

In example aspects, the garment may comprise sleeves having a proximal end and a distal end. A posterior portion of the proximal end of each sleeve may be permanently affixed to a torso portion of the garment adjacent to a posterior edge of a sleeve opening of the garment. And an anterior portion of the proximal end of each sleeve may be releasably coupled to the torso portion adjacent to an anterior edge of the sleeve opening of the garment. The garment may additionally comprise a pocket located on an inner-facing surface of a back aspect of the torso portion of the garment where the pocket extends across a vertical midline of the back aspect. When the garment is in the form of a jacket, the anterior portion of each of the sleeves is releasably coupled to the torso portion adjacent to the anterior edge of the sleeve openings so that the sleeves are secured to the torso portion of the garment, and a wearer may don the jacket by passing her arms through the sleeve openings and into the sleeves.

When the wearer wishes to convert the jacket to a vest, the wearer can, in example aspects, doff the jacket, uncouple the anterior portion of the proximal end of each sleeve from the torso portion adjacent to the anterior edge of the sleeve openings of the garment, manipulate the distal end of the sleeves inwardly through the sleeve openings, and stow both of the sleeves in the pocket located on the inner-facing surface of the back aspect of the torso portion of the garment. Because of the permanent attachment of the posterior portion of the proximal end of each sleeve to the torso portion of the garment, the sleeves still remain attached to the garment which helps prevent inadvertent loss of the sleeves. Further, by positioning the pocket used to stow the sleeves on the inner-facing surface of the back aspect of the torso portion, the stowed sleeves generally do not interfere with wearer movement or comfort, and the aesthetic features of the garment are maintained (i.e., the stowed sleeves do not affect the contours of the front of the garment and the stowed sleeves are not visible when viewing the back of the garment). In addition, use of a single pocket to stow the sleeves, as opposed to multiple pockets, reduces manufacturing steps and costs, and contributes to a lighter weight for the garment.

Positional terms as used herein to describe the convertible vest and jacket system such as "front," "back," "upper," "proximal," "distal," "anterior," "posterior," "lower," "bottom," "inner-facing surface," "outer-facing surface," and the like are to be given their customary meaning with respect to an appropriately sized upper-body garment worn as intended and as shown and described herein by a wearer standing in an upright position. For example, the "front" of a garment is configured to cover a front torso area and/or a front arm area of a wearer, and the "back" of the garment is configured to cover a back torso area and/or a back arm area of the wearer. The term "about" when used in relation to measurements means within ±10% of a designated value. Terms such as "attached," "secured," "affixed," and the like may mean elements that are releasably attached to one another using, for example, snap systems, slider systems, hook-and-loop closure systems, releasable adhesives, buttons, hooks, and the like. These terms may further mean elements that are permanently attached to one another using, for example, stitching, bonding, welding, and the like.

The term "mesh," or "mesh material" as used herein may mean a textile having a large number of closely spaced holes. Aspects herein contemplate that the mesh material may be formed from a loosely knitted or woven textile, or the mesh material may be formed by perforating a textile in a post-weaving or post-knitting step to form the holes. The term "first vest state" as used herein refers to the convertible vest and jacket system when the system is in the form of a vest (i.e., a sleeveless garment configured to primarily cover a wearer's torso portion). And the term "second jacket state" as used herein refers to the convertible vest and jacket system when the system is in the form of a jacket (i.e., a garment having sleeves). The term "releasable fastener system" as used herein refers to a fastener system that can be repeatedly coupled and uncoupled to respectively secure or disengage components from each other. Example releasable fastener systems may include buttons, snaps, hook-and-loop fasteners, slider systems including zippers, and the like. In line with this, the term "complementary" when describing components of a releasable fastener system means components having structures that mechanically engage with each other.

Figure 2:
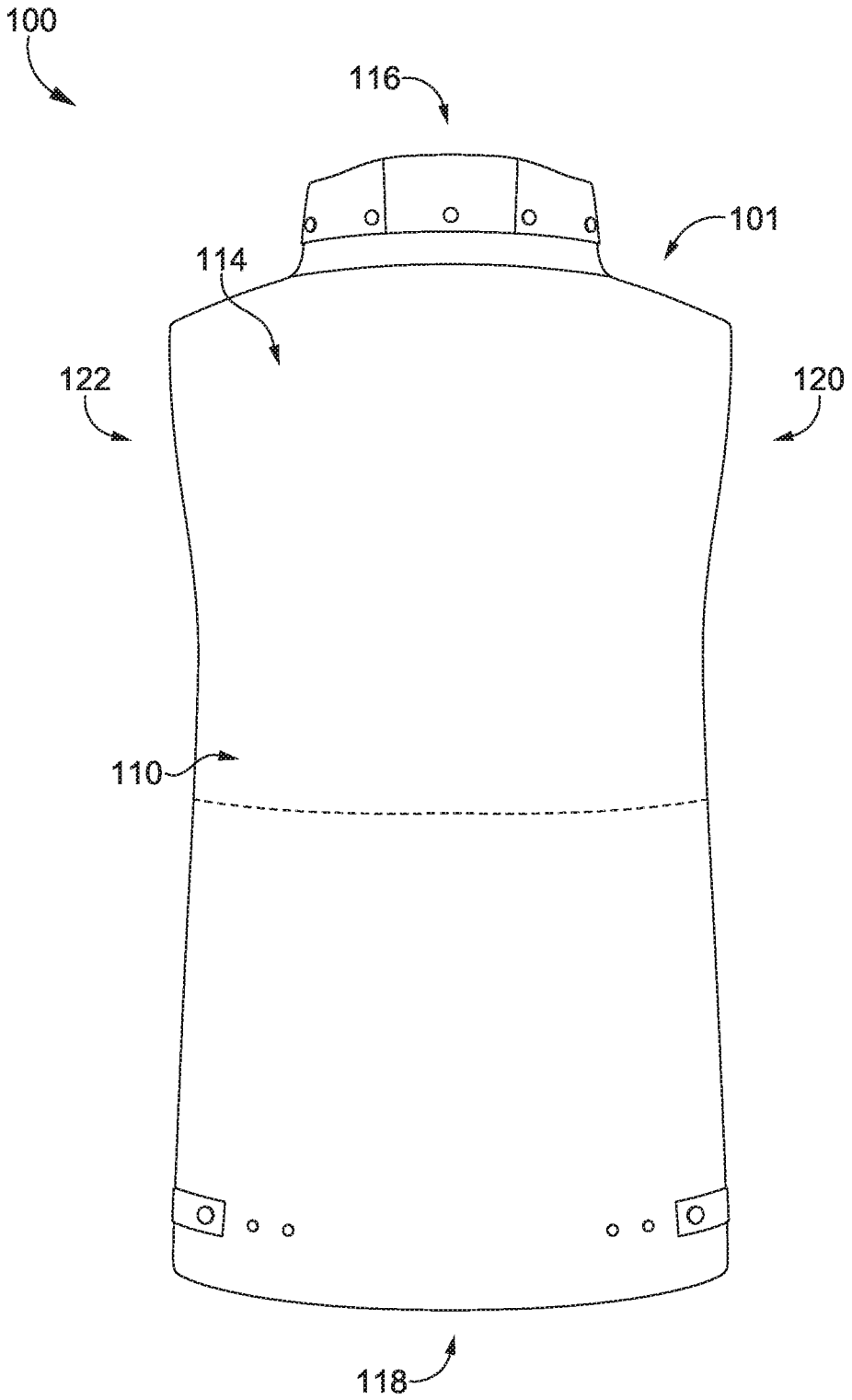
FIG. 2 illustrates a back view of the vest of FIG. 1 in accordance with aspects herein.

Turning now to FIGS. 1 and 2, front and back views of a garment 100 in the form of a vest 101 are illustrated in accordance with aspects herein. The vest 101 comprises a torso portion 110 having a front aspect 112 shown in FIG. 1 and a back aspect 114 shown in FIG. 2. The front aspect 112 and the back aspect 114 together define a neck opening 116, a waist opening 118, a first sleeve opening 120, and a second sleeve opening 122. In example aspects, the front aspect 112 of the vest 101 comprises a slider system 124 that can be used to releasably couple a first front aspect half 126 and a second front aspect half 128. The vest 101 may optionally comprise features such as a hood (not shown) that can be stowed, for instance, in a collar portion of the vest 101. The vest 101 may also optionally comprise additional features such as pockets, and adjustment systems that enable, for instance, the circumference of the waist opening 118 to be adjusted and/or the circumference of distal sleeve openings to be adjusted.

With respect to the first sleeve opening 120 and the second sleeve opening 122, each of the first and second sleeve openings 120 and 122 comprises an anterior edge 130 and a posterior edge 132 (shown in FIG. 1) that generally circumscribe the respective first and second sleeve openings 120 and 122. To describe this differently, the anterior edge 130 of the first and second sleeve openings 120 and 122 is generally formed by the front aspect 112 of the vest 101, and the posterior edge 132 of the first and second sleeve openings 120 and 122 is generally formed by the back aspect 114 of the vest 101. In example aspects, a releasable fastener 134 is located adjacent to (within from about 1 cm to about 8 cm) the anterior edge 130 of the first sleeve opening 120 and the second sleeve opening 122, and the releasable fastener 134 is positioned on an inner-facing surface of the vest 101. The releasable fastener 134 may comprise, for instance, a hook component of a hook-and-loop fastener system or a loop component of a hook-and-loop fastener system, a button hole or a button, a female snap component or a male snap component (including magnetic snap components), and the like. Continuing, in example aspects, there may be more than one releasable fastener 134 positioned adjacent to the anterior edge 130 of the first and second sleeve openings 120 and 122. As shown in FIG. 1, in example aspects, there may comprise a first releasable fastener 134 positioned toward the superior part of the first and second sleeve openings 120 and 122 and a second releasable fastener 134 positioned toward the inferior part of the first and second sleeve openings 120 and 122. Additional releasable fasteners are contemplated herein including a slider system. Providing more than one releasable fastener 134 for each of the first and second sleeve openings 120 and 122 may provide a more secure attachment of the sleeves of the garment 100.

Figure 3:
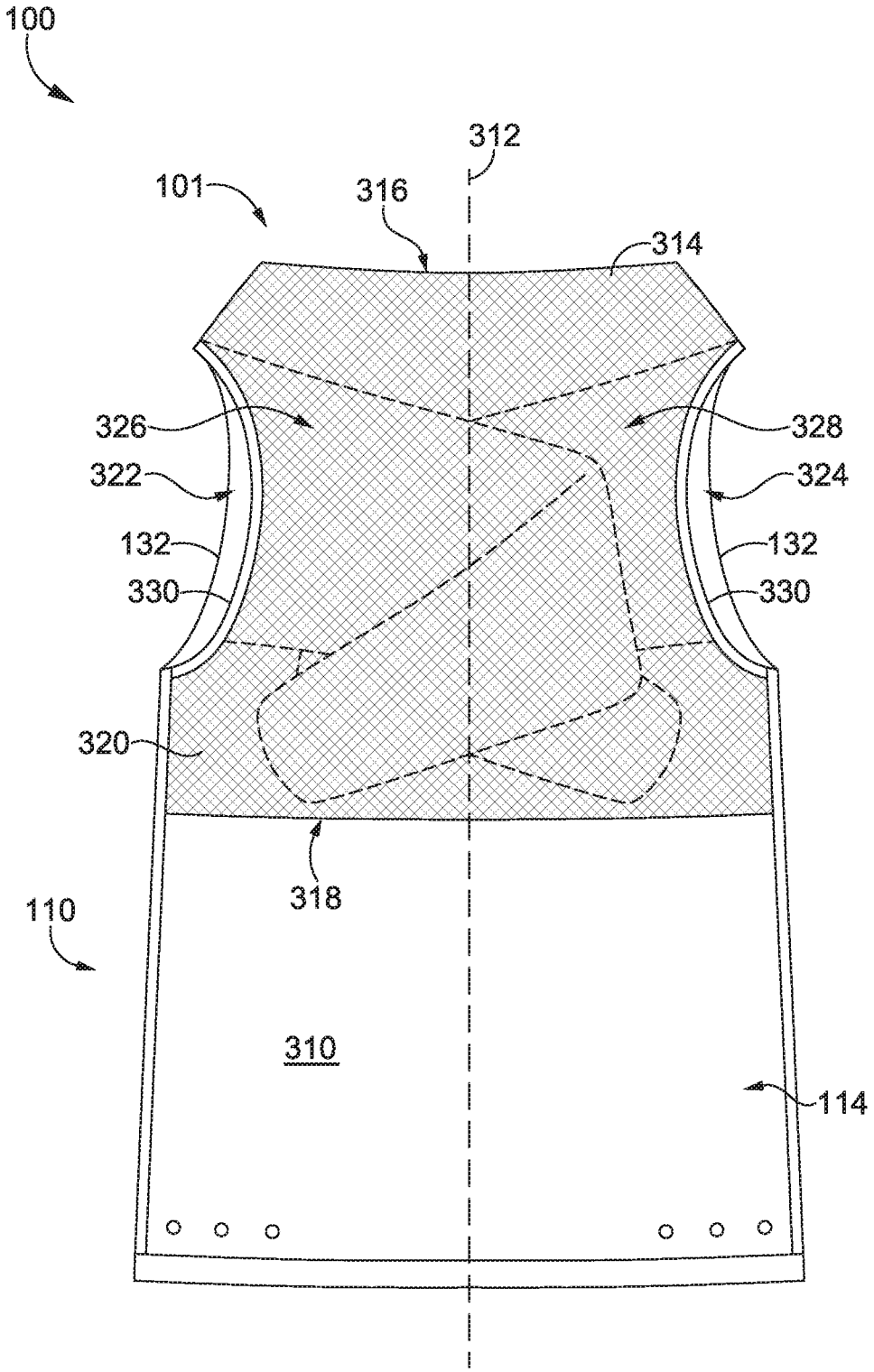
FIG. 3 illustrates a view of the vest of FIG. 1 with the front of the vest removed to better illustrate a pocket located on an inner-facing surface of the back of the vest, where sleeves are stowed within the pocket in accordance with aspects herein.

FIG. 3 is provided to illustrate additional features of the vest 101 of the garment 100 in accordance with aspects herein. In FIG. 3, the front aspect 112 of the vest 101 is removed to provide a view of the inner-facing surface 310 of the back aspect 114 of the torso portion 110. As will be referenced below, a hypothetical vertical midline 312 is depicted which divides the back aspect 114 into generally equal left and right halves where the hypothetical vertical midline 312 extends from an approximate center of the neck opening 116 to an approximate center of the waist opening 118.

In example aspects, the vest 101 comprises a pocket 314 positioned on the inner-facing surface 310 of the back aspect 114 where the pocket 314 extends across the vertical midline 312. In example aspects, the pocket 314 may be positioned such that the vertical midline 312 bisects the pocket 314 into two generally equal right and left halves. Further, in example aspects, the pocket 314 is positioned on an upper half of the back aspect 114 of the torso portion 110. For instance, an upper margin 316 of the pocket 314 may be positioned adjacent (with about 0 cm to about 10 cm) to the neck opening 116, and a bottom margin 318 of the pocket 314 may be positioned approximately halfway (±about 20 cm) between the neck opening 116 and the waist opening 118.

Continuing, the pocket 314 may be formed in example aspects by positioning a material 320 such as a mesh material adjacent to the inner-facing surface 310 of the back aspect 114 so that a single, continuous, uninterrupted pocket space is formed between the two layers where the single, continuous, uninterrupted pocket space extends across the vertical midline 312. Use of a mesh material may contribute to wearer comfort by facilitating air movement between the pocket space and, for instance, a wearer's body. Also, use of a mesh material may help decrease the weight of the garment 100. In example aspects, the material 320 may be affixed to the inner-facing surface 310 of the back aspect 114 at least at its upper margin 316 and its bottom margin 318. It may also be affixed along a portion of its side margins as shown in FIG. 3. The pocket 314 may comprise a first pocket opening 322 positioned on a first lateral side of the pocket 314, and the pocket 314 may comprise a second pocket opening 324 positioned on a second lateral side of the pocket 314. In example aspects, each of the first and second pocket openings 322 and 324 may comprise an inner pocket opening edge 330 and an outer pocket opening edge. The inner pocket opening edge 330 may be formed from the material 320 and the outer pocket opening edge may comprise the posterior edge 132 of each of the first and second sleeve openings 120 and 122. The inner pocket opening edge 330 and the posterior edge 132 of the first and second sleeve openings 120 and 122 together circumscribe or define the first and second pocket openings 322 and 324. Because the posterior edge 132 of the first and second sleeve openings 120 and 122 forms the outer pocket opening edge, the first pocket opening 322 and the second pocket opening 324 are positioned adjacent and medial to the first and second sleeve openings 120 and 122 (e.g., within from about 0 cm to about 10 cm of the first and second sleeve openings 120 and 122). With continued respect to FIG. 3, when the garment 100 is in the form of the vest 101, a first sleeve 326 and a second sleeve 328 of the garment 100 are stowed within the pocket 314 (the first and second sleeves 326 and 328 are shown in dashed line to indicate they are positioned interior to the material 320.

Use of a single pocket to stow the first and second sleeves 326 and 328 reduces the number of manufacturing steps used to manufacture the garment 100. As well, positioning the pocket 314 on an upper half of the inner-facing surface 310 of the back aspect 114 of the torso portion 110 helps to maintain the aesthetic profile of, for example, the front aspect 112 and the back aspect 114 of the vest 101. That is, by stowing the first and second sleeves 326 and 328 as shown, the contour profiles of the front aspect 112 of the vest 101 are unaltered, and the first and second sleeves 326 and 328 are not seen when viewing the back aspect 114 of the vest 101. As well, by positioning the pocket 314 as shown, arm movements of a wearer are generally unimpeded when the first and second sleeves 326 and 328 are stowed. An additional advantage of the pocket 314 is that the positioning of the first and second pocket openings 322 and 324 adjacent to the first and second sleeve openings 120 and 122 facilitates the easy storage of the first and second sleeves 326 and 328 as further explained below. Additional features of the first and second sleeves 326 and 328 will be discussed after describing the garment 100 when it is in the form of a jacket.

Figure 4:
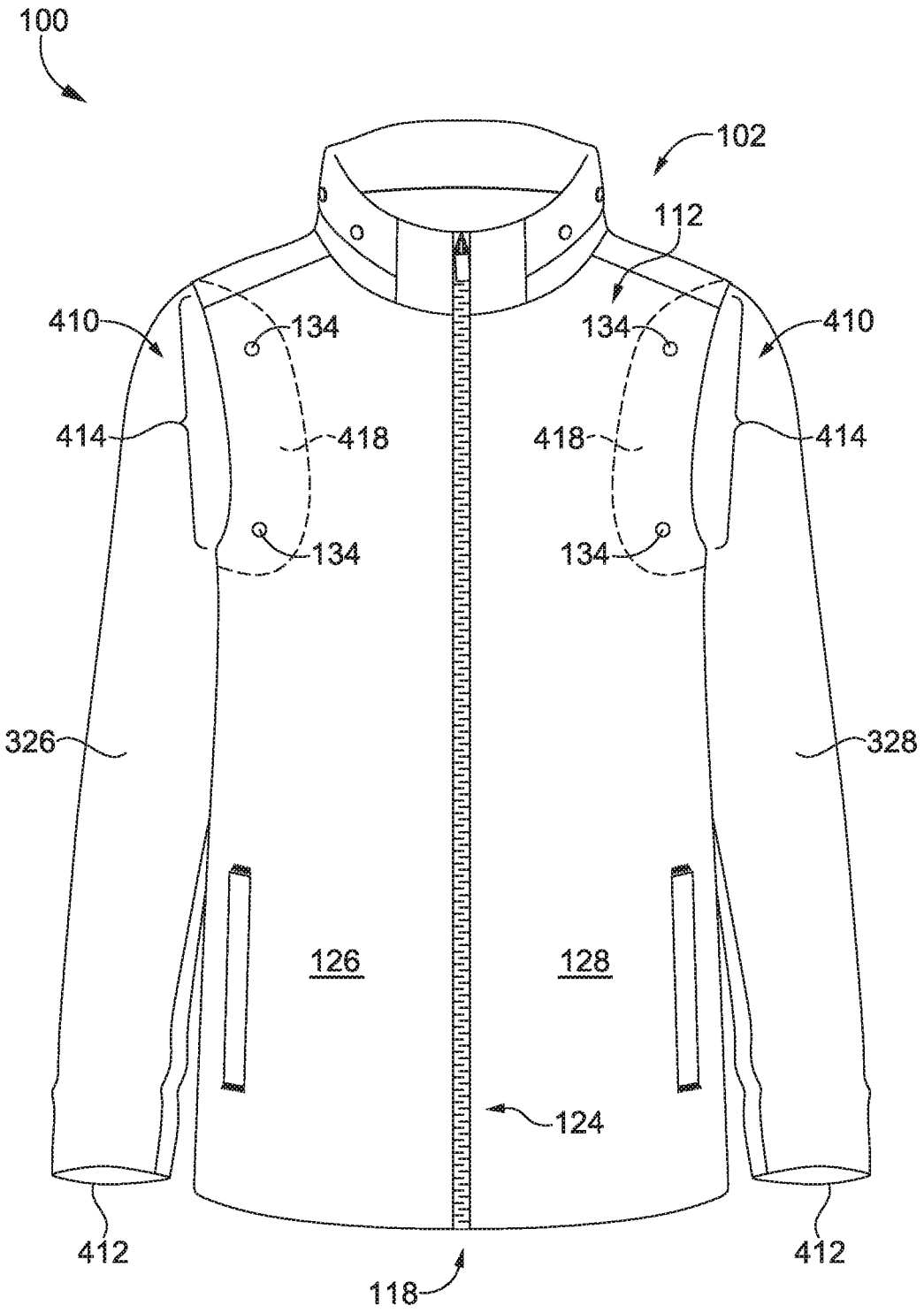
FIG. 4 illustrates a front view of the example convertible vest/jacket of FIG. 1 in a second jacket state in accordance with aspects herein.
Figure 5:
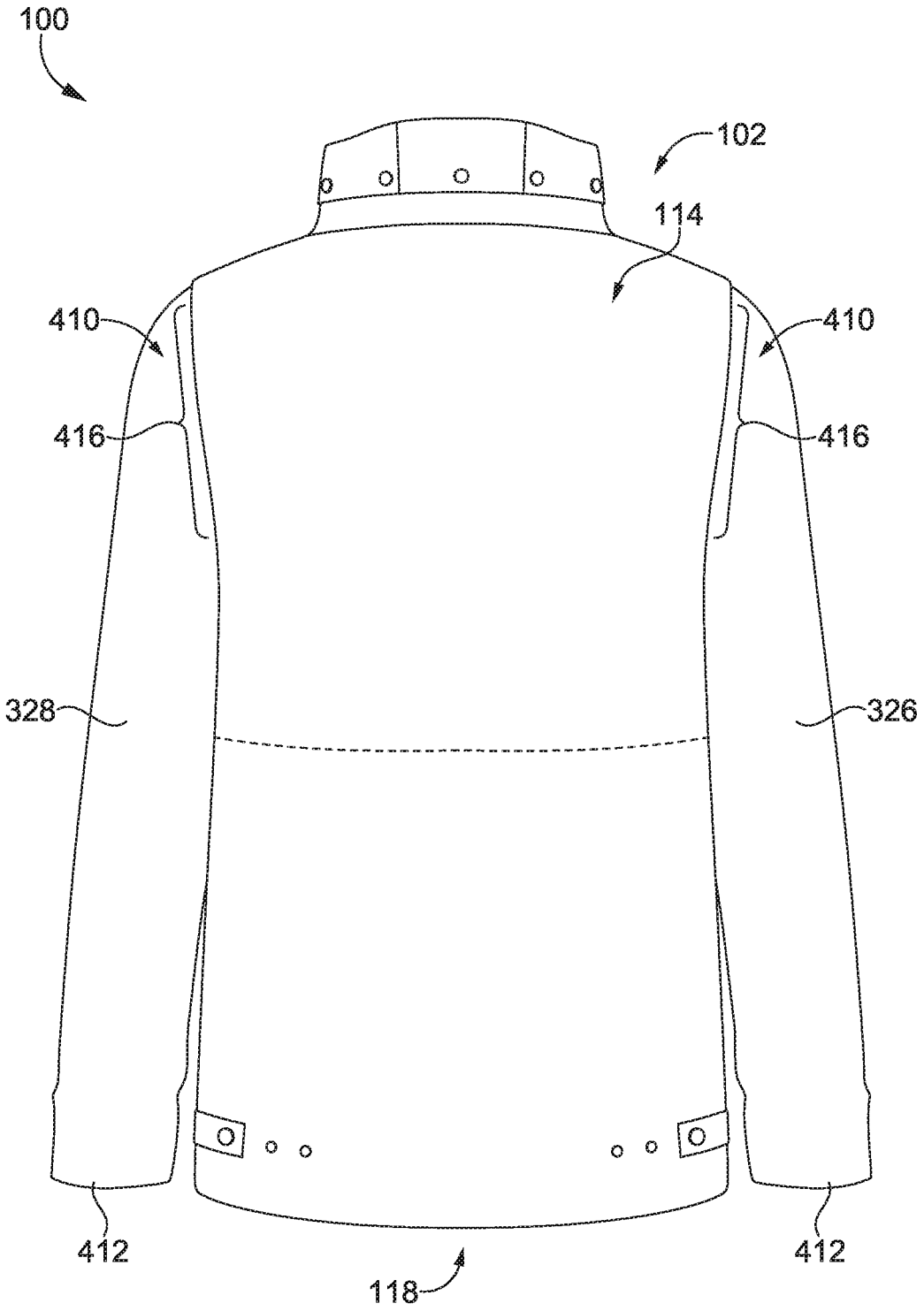
FIG. 5 illustrates a back view of the jacket of FIG. 4 in accordance with aspects herein.

FIGS. 4 and 5 depict the garment 100 in the form of a jacket 102 in accordance with aspects herein. The jacket 102 includes the torso portion 110 of the vest 101 but also comprises the first sleeve 326 and the second sleeve 328. Each of the first sleeve 326 and the second sleeve 328 comprises a proximal end 410 and a distal end 412. As used herein, the term "proximal end" may include a terminal proximal edge of each of the first sleeve 326 and the second sleeve 328 and may further include areas adjacent to the terminal proximal edge (within about 10 cm of the terminal proximal edge). The term "distal end" as used herein may include a terminal distal edge (i.e., a cuff edge) of the first and second sleeves 326 and 328 and may further include areas adjacent to the terminal distal edge (within about 10 cm of the terminal distal edge). The proximal end 410 of the first and second sleeves 326 and 328 comprises a forward-facing portion or an anterior portion 414 shown in FIG. 4 and a back-facing portion or posterior portion 416 shown in FIG. 5. With respect to the anterior portion 414 of the first and second sleeves 326 and 328, the anterior portion 414 comprises a material extension 418 (shown in dashed lines to indicate it is generally positioned in the interior of the garment 100 and is thus hidden from view). This aspect is shown in greater detail in FIG. 6 which illustrates an isolated view of the first sleeve 326 including the anterior portion 414 with its material extension 418. A discussion of FIG. 6 is equally applicable to the second sleeve 328.

Figure 6:
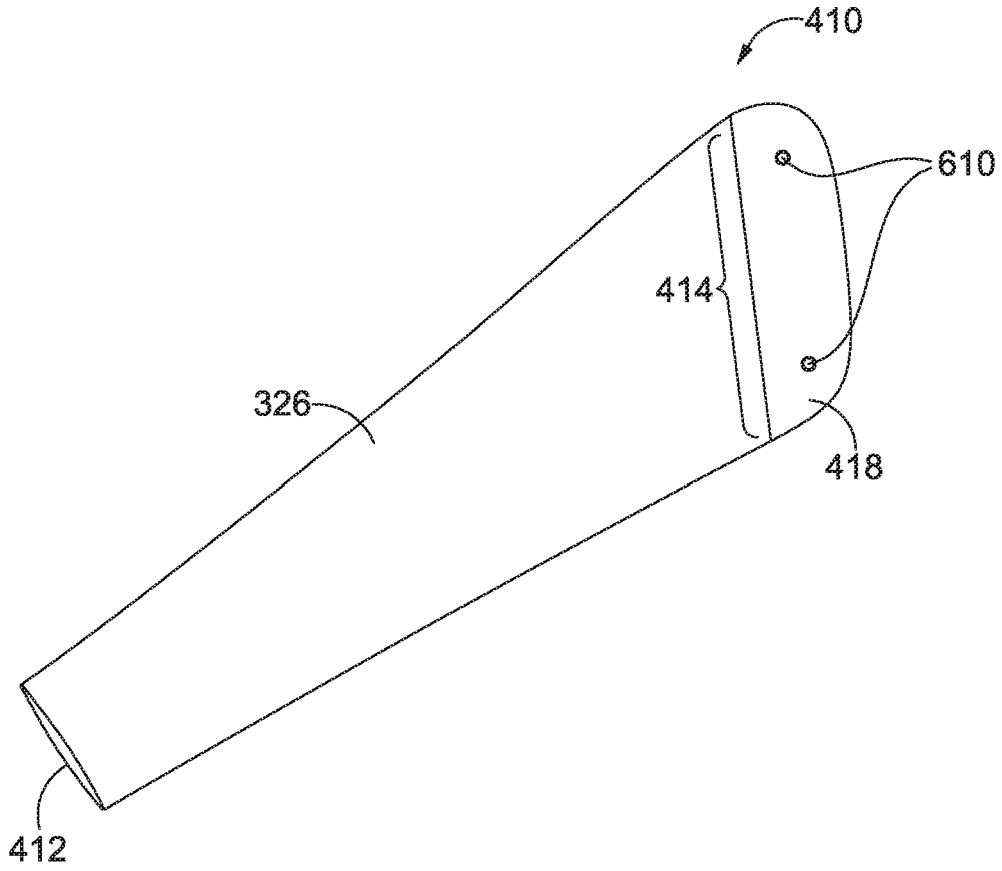
FIG. 6 illustrates an isolated front view of a sleeve used in the convertible vest/jacket in accordance with aspects herein.

Continuing with respect to FIG. 6, the material extension 418 represents a medially extending extension of the proximal end 410 of the first sleeve 326 on the anterior or forward-facing side of the first sleeve 326. It may comprise an integrally knitted or woven extension of the respective knitted or woven textile used to form the first sleeve 326, or it may comprise a separate panel piece affixed to the first sleeve 326 using known affixing technologies. In example aspects, the outer perimeter edge of the material extension 418 comprises a generally arcuate shape. A releasable fastener 610 is positioned on an outer-facing surface of the material extension 418, where the releasable fastener 610 is complementary to the releasable fastener 134 located on the inner-facing surface 310 of the torso portion 110 adjacent to the first sleeve opening 120. As such, in example aspects, the releasable fastener 610 may comprise a hook or loop component of a hook-and-loop fastener system that is complementary to the releasable fastener 134, a button hole or a button that is complementary to the releasable fastener 134, a female snap component or a male snap component that is complementary to the releasable fastener 134, and the like. In example aspects, the number of releasable fasteners 610 on the material extension 418 may be the same as the number of releasable fasteners 134. The mating of the releasable fastener 610 with the releasable fastener 134 releasably secures the proximal end of the first sleeve 326 to the torso portion 110 of the garment 100.

Figure 7:
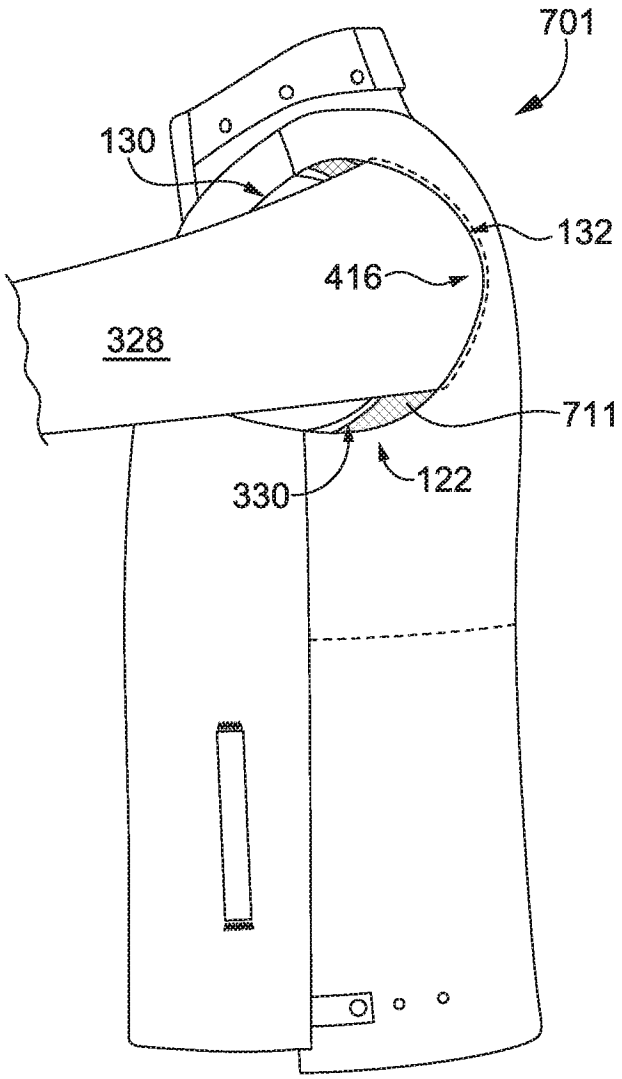
FIG. 7 illustrates a side view of an example convertible vest/jacket where a posterior portion of a sleeve is affixed to a posterior edge of a sleeve opening in accordance with aspects herein.

With respect to the posterior portion 416 of the proximal end 410 of the first sleeve 326 and the second sleeve 328, it is contemplated herein that in one example aspect, the posterior portion 416 of the proximal end 410 is permanently affixed to the posterior edge 132 of the first sleeve opening 120 and the second sleeve opening 122 respectively using affixing technologies such as stitching, bonding, welding, and the like. This is illustrated in FIG. 7 which depicts a side view of an example convertible vest jacket 701 and specifically illustrates the second sleeve opening 122. The description that follows is also applicable to the first sleeve opening 120. The second sleeve opening 122 is formed from the anterior edge 130 and the posterior edge 132 of the second sleeve opening 122. Also seen is the inner pocket opening edge 330 and the pocket space (now labelled by reference numeral 711) formed between the material 320 and the inner-facing surface 310 of the back aspect 114 of the torso portion 110. The posterior portion 416 of the second sleeve 328 is shown affixed to the posterior edge 132 of the second sleeve opening 122 by, for instance, stitching.

Figure 8:
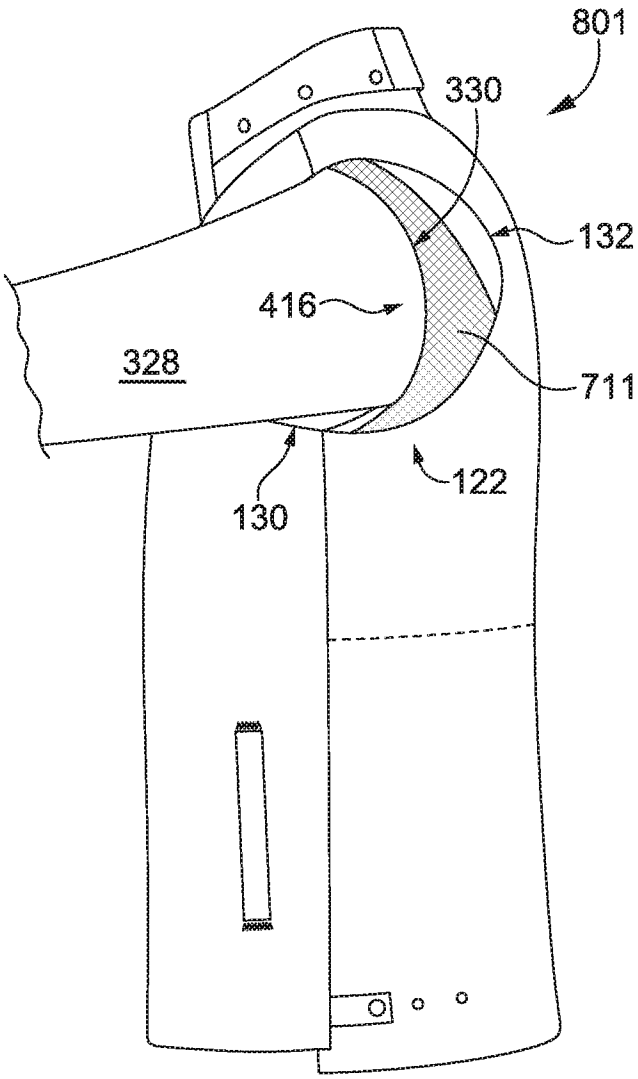
FIG. 8 illustrates a side view of an alternative example convertible vest/jacket where a posterior portion of a sleeve is affixed to an inner pocket opening edge of a pocket in accordance with aspects herein.

In an alternative example aspect, it is contemplated herein that the posterior portion 416 of the proximal end 410 of the first and second sleeves 326 and 328 is permanently affixed to the inner pocket opening edge 330 of the pocket 314 as opposed to the posterior edge 132 of the first and second sleeve openings 120 and 122. This is illustrated in FIG. 8 which depicts a side view of an example convertible vest/jacket 801 and specifically illustrates the second sleeve opening 122. The description that follows is also applicable to the first sleeve opening 120. As stated above, the second sleeve opening 122 is formed from the anterior edge 130 and the posterior edge 132 of the second sleeve opening 122. Also shown in FIG. 8 is the inner pocket opening edge 330 and the pocket space 711. The posterior portion 416 of the second sleeve 328 is shown as affixed to the inner pocket opening edge 330 of the pocket 314. With respect to this aspect, it is contemplated herein that the posterior edge 132 of the second sleeve opening 122 may be releasably affixed (using, for instance, a hook-and-loop fastener system, snaps, buttons, and the like) to the inner pocket opening edge 330 to effectively prevent an open communication path between the pocket space 711 and the external environment. However, it is also contemplated herein that the posterior edge 132 of the second sleeve opening 122 may remain detached from or unaffixed from the inner pocket opening edge 330. By providing a permanent attachment between the posterior portion 416 of the proximal end 410 of each of the first sleeve 326 and the second sleeve 328 and either the posterior edge 132 of the first and second sleeve openings 120 and 122 or the inner pocket opening edge 330 of the pocket 314, the first and second sleeves 326 and 328 may be prevented from inadvertently becoming lost when doffed.

Figure 10:
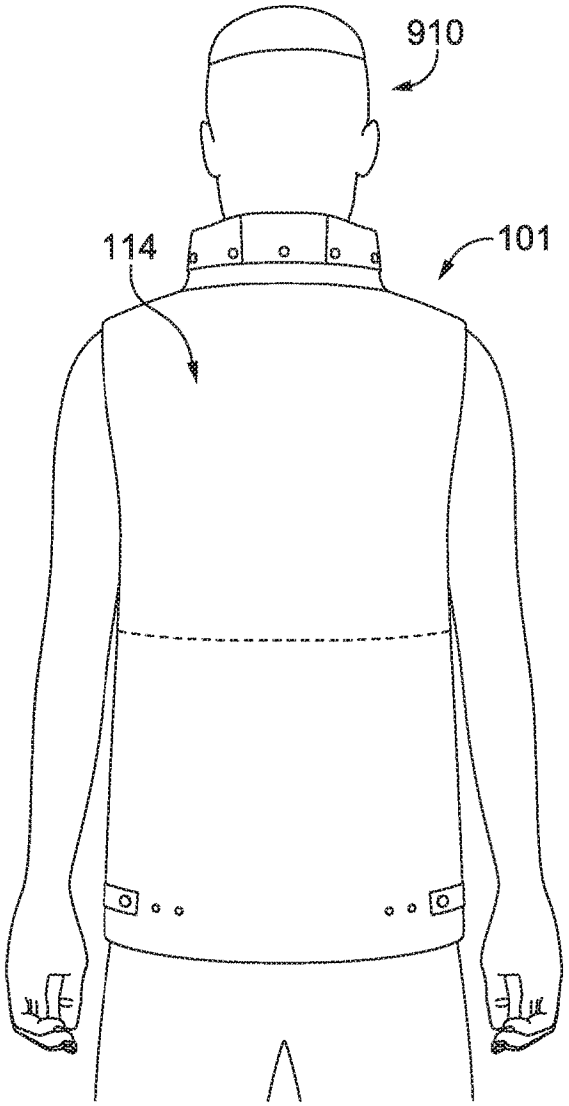
FIGS. 9-14 illustrate an example method of converting a vest into a jacket in accordance with aspects herein.
Figure 9:
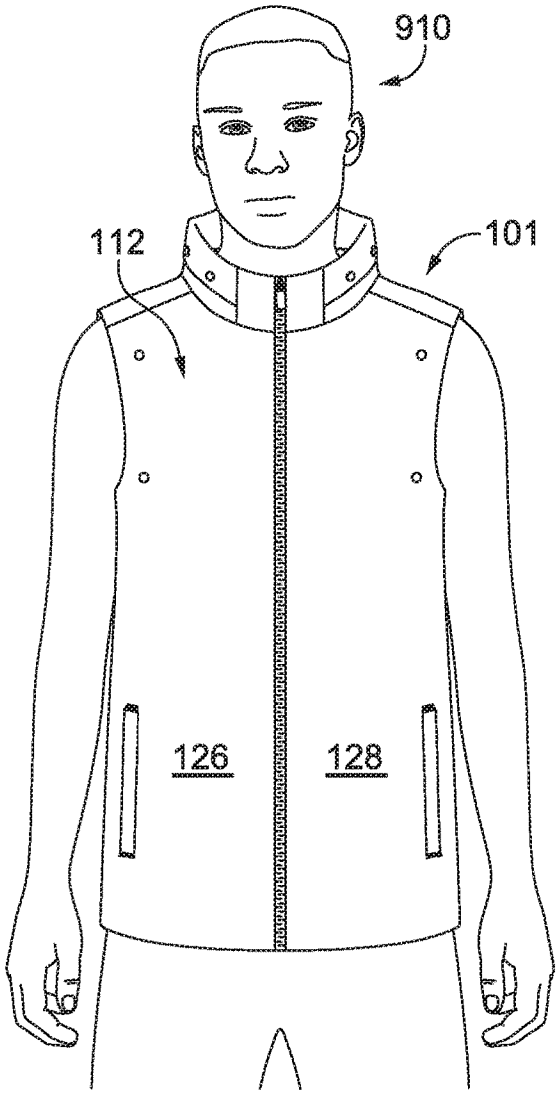

FIGS. 9-14 illustrate an example method of converting the garment 100 from a vest 101 to a jacket 102 in accordance with aspects herein. FIG. 9 illustrates a front view of a wearer 910 wearing the garment 100 when it is in the form of a vest 101, and FIG. 10 illustrates a back view of the wearer 910 wearing the vest 101. As shown in FIG. 9, the aesthetic profile of the front aspect 112 of the vest 101 is similar to a traditional vest. That is, because the first and second sleeves 326 and 328 are stowed in the pocket 314 positioned on the inner-facing surface 310 of the back aspect 114 of the torso portion 110, the stowed first and second sleeves 326 and 328 do not affect the contour profiles of the front aspect 112 of the vest 101. With respect to the back view of FIG. 10, because the pocket 314 is positioned on an upper portion of the back aspect 114 of the torso portion 110, the stowed first and second sleeves 326 and 328 are situated in the space between the wearer's shoulder blades. Positioning the first and second sleeves 326 and 328 in this location generally prevents the first and second sleeves 326 and 328 from interfering with the wearer's movements. Moreover, because the pocket 314 is positioned on the inner-facing surface 310 of the back aspect 114, the first and second sleeves 326 and 328 are not visible when the garment 100 is viewed from the back.

Figure 11:
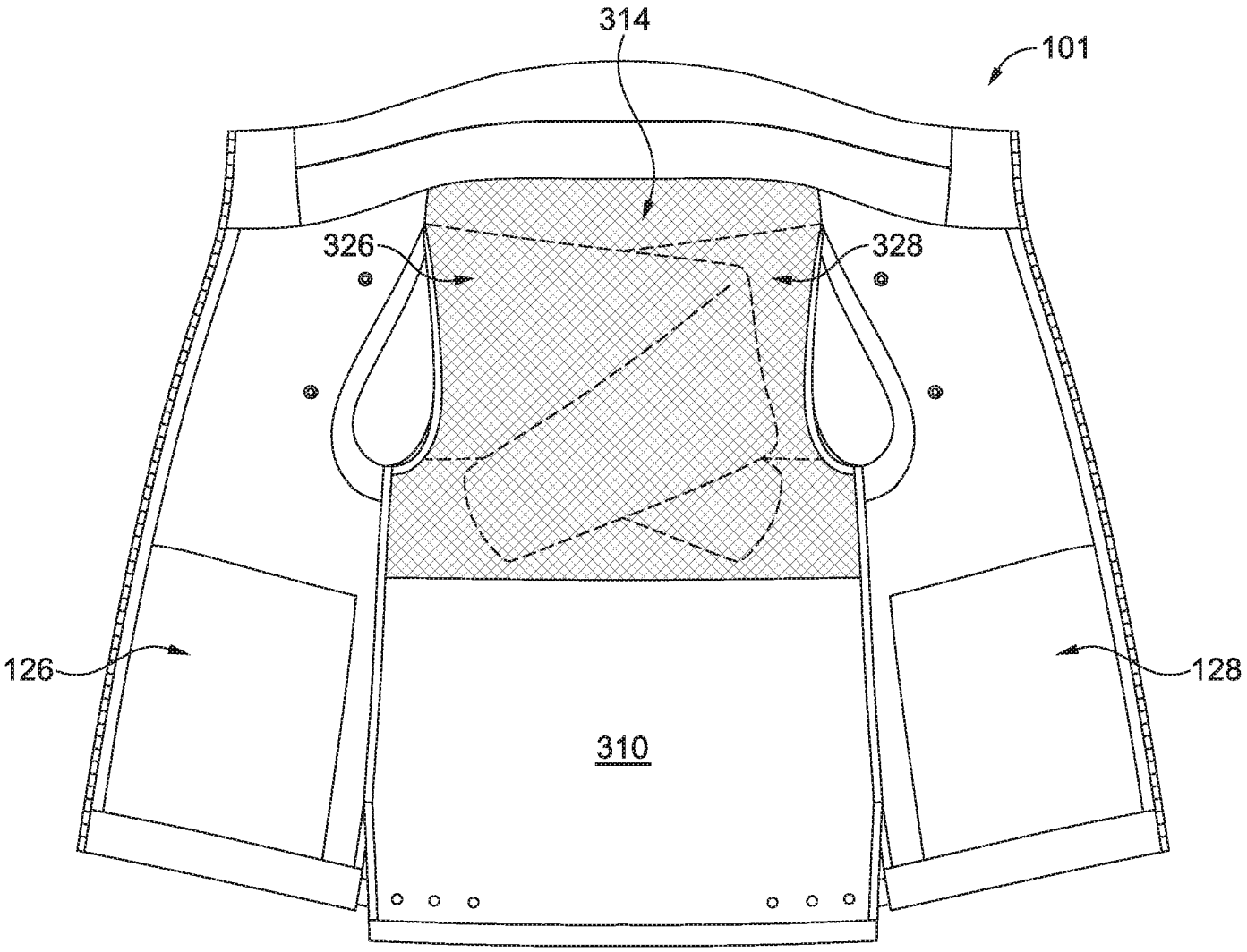
Figure 12:
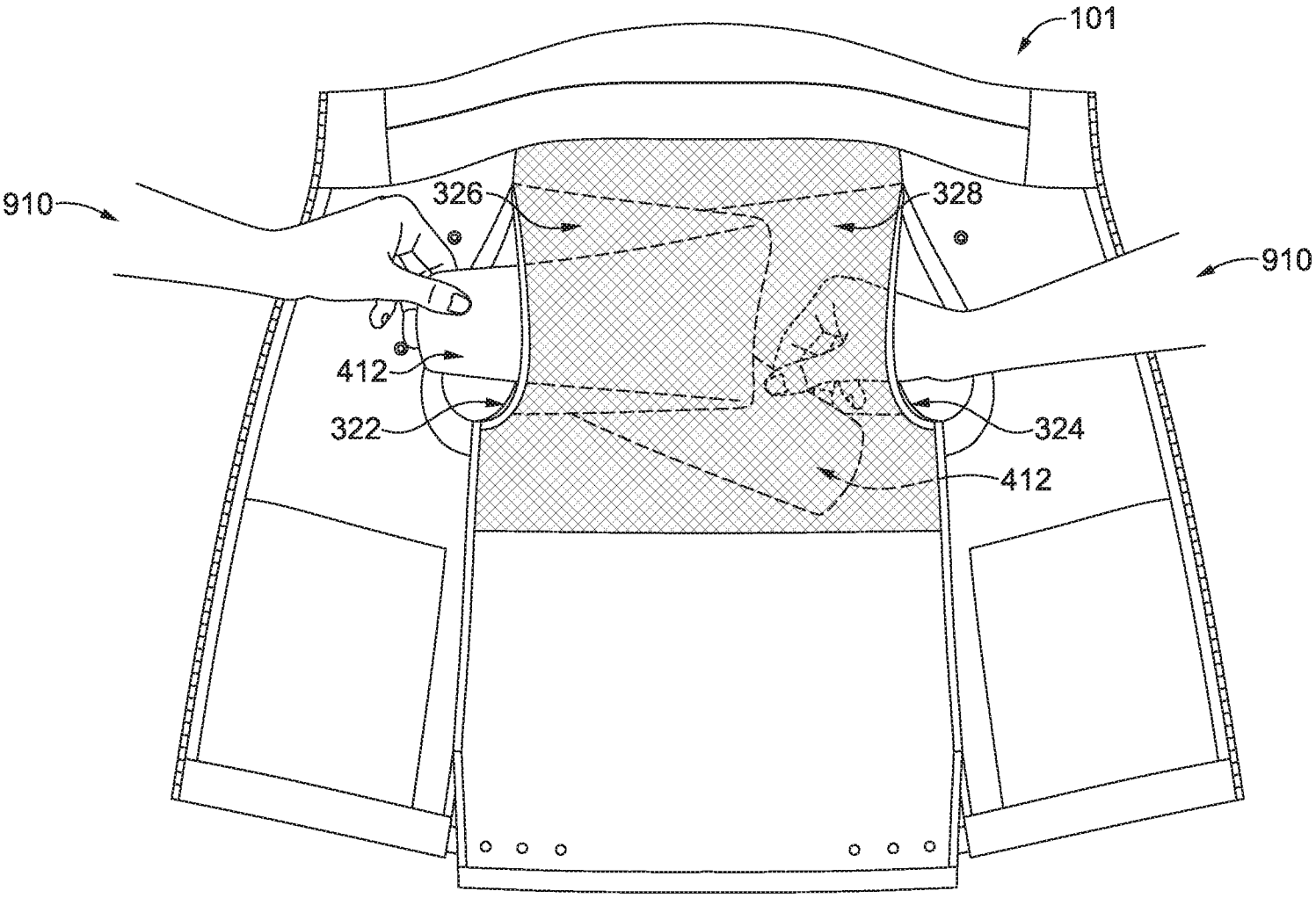
Figure 13:
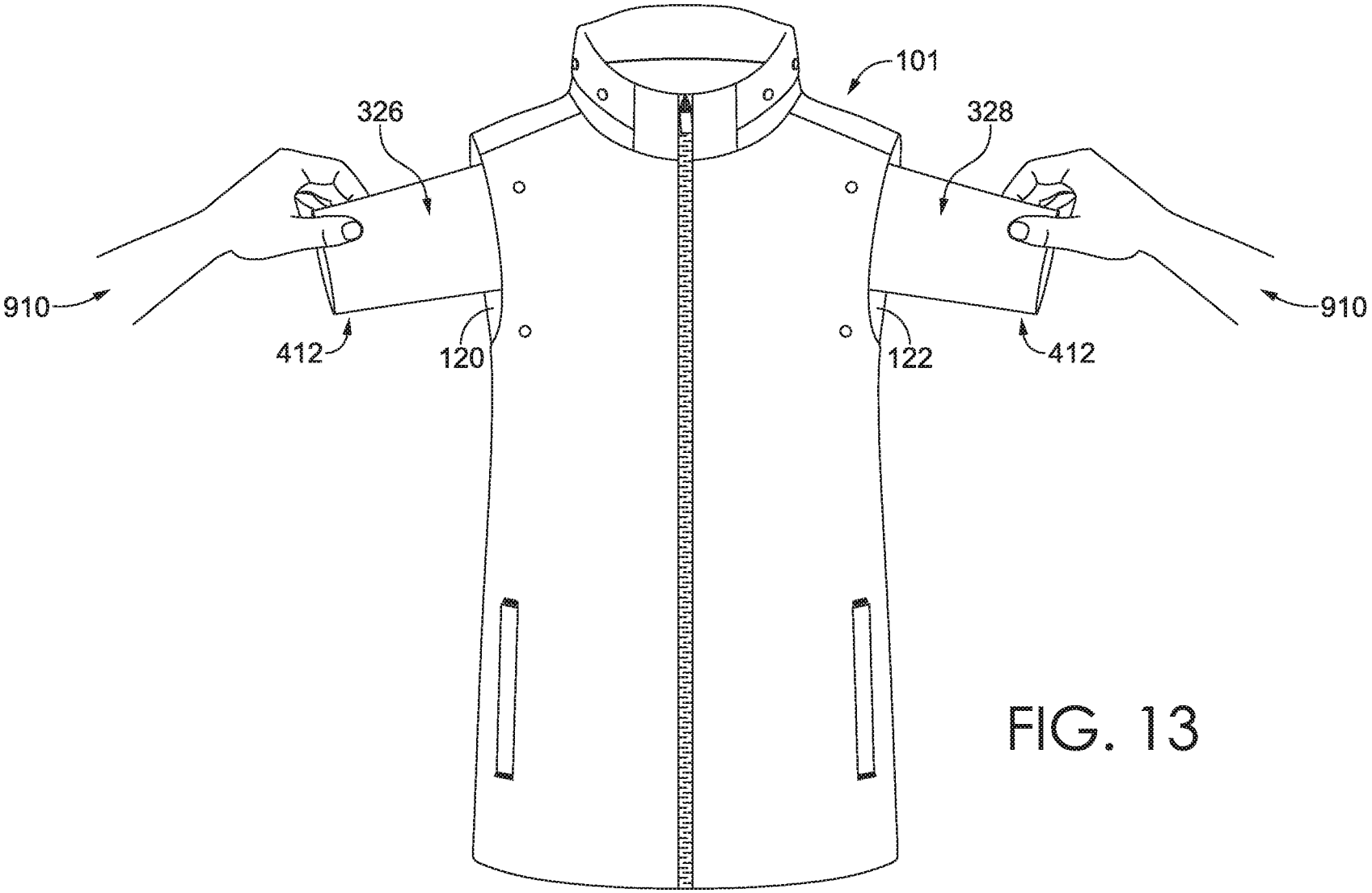

FIG. 11 illustrates the vest 101 after it has been doffed by the wearer 910. Once doffed, the first front aspect half 126 and the second front aspect half 128 may be pulled apart as shown to expose the pocket 314 positioned on the inner-facing surface 310 of the back aspect 114 of the torso portion 110, where the pocket 314 contains the stowed first and second sleeves 326 and 328. FIG. 12 illustrates the wearer 910 reaching into the first pocket opening 322 and the second pocket opening 324 to retrieve, for instance, the distal end 412 of each of the first sleeve 326 and the second sleeve 328. FIG. 13 illustrates the wearer 910 withdrawing the distal end 412 of each of the first sleeve 326 and the second sleeve 328 from the pocket 314 and pulling the distal ends 412 through the first sleeve opening 120 and the second sleeve opening 122 respectively.

Figure 14:
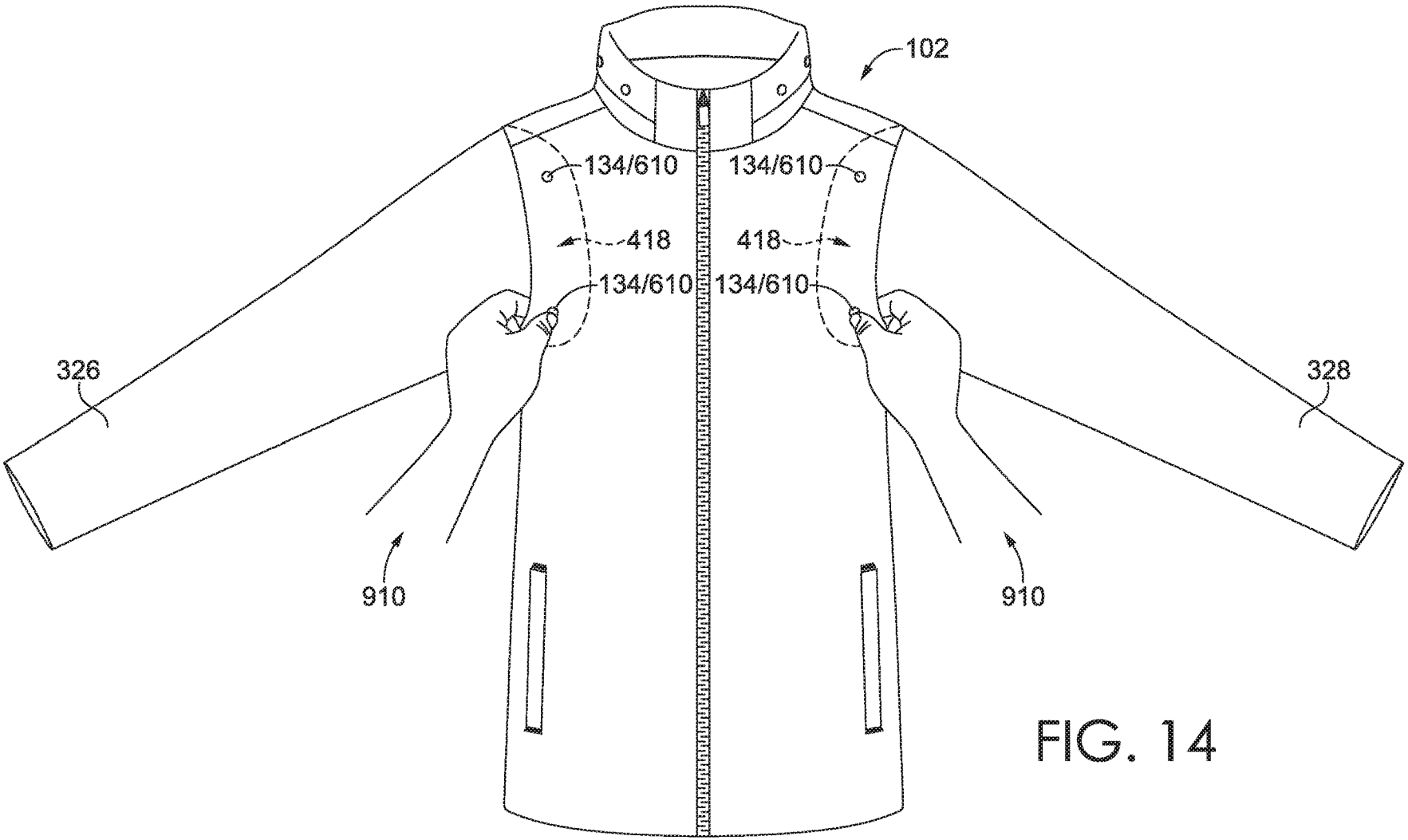

With respect to FIG. 14, the wearer 910 is shown securing the releasable fasteners 610 positioned on the material extension 418 of the first sleeve 326 and the second sleeve 328 to the releasable fasteners 134 positioned on the inner-facing surface 310 of the torso portion 110 thus releasably securing the first sleeve 326 and the second sleeve 328 to the torso portion 110 to form the jacket 102. Converting the jacket 102 to the vest 101 would involve a reverse order of steps.

Figure 15:
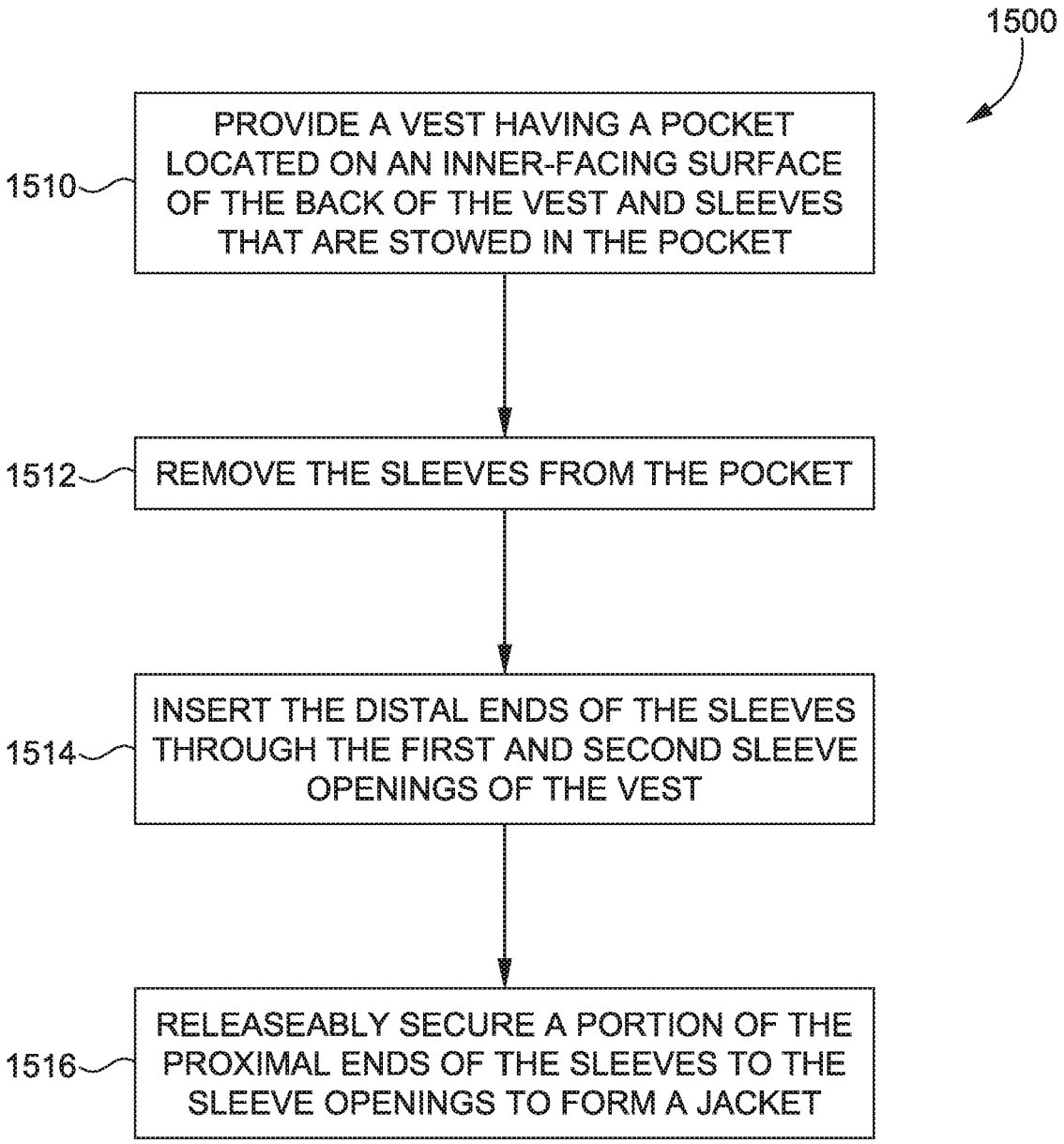
FIG. 15 illustrates a flow diagram of an example method of using a convertible vest and jacket system in accordance with aspects herein.

FIG. 15 depicts a flow diagram of an example method 1500 of using the convertible vest and jacket system described herein in accordance with aspects herein. At a step 1510, a vest is provided, such as the vest 101, where the vest comprises a torso portion having a front aspect and a back aspect, a first sleeve opening and a second sleeve opening. The vest also comprises a pocket located on an inner-facing surface of the back aspect of the torso portion, where the pocket includes a first pocket opening positioned adjacent and medial to the first sleeve opening and a second pocket opening positioned adjacent and medial to the second sleeve opening. Further, the vest comprises a first sleeve and a second sleeve each having a proximal end and a distal end. A posterior portion of the proximal end of each of the first sleeve and the second sleeve is permanently affixed to the torso portion adjacent to a posterior edge of the first sleeve opening and the second sleeve opening respectively (i.e., within about 0 cm to about 10 cm of the sleeve openings). And an anterior portion of the proximal end of each of the first sleeve and the second sleeve is unaffixed from or detached from the anterior edge of the first sleeve opening and the second sleeve opening respectively. Both the first sleeve and the second sleeve are stowed within the pocket.

At a step 1512, the first sleeve and the second sleeve are removed from the pocket using the first pocket opening for the first sleeve and the second pocket opening for the second sleeve. And at a step 1514, the distal end of each of the first sleeve and the second sleeve is inserted through the first sleeve opening and the second sleeve opening respectively (i.e., from an interior of the sleeve openings to an exterior of the sleeve openings) and each of the first sleeve and the second sleeve is extended through the openings. At a step 1516, the anterior portion of the proximal end of each of the first sleeve and the second sleeve is releasably affixed or secured to the torso portion adjacent to the anterior edge of the first sleeve opening and the second sleeve opening (i.e., within about 0 cm to about 10 cm of the sleeve openings) to form the jacket.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A convertible vest and jacket system comprising:

in a first vest state:

a torso portion having a front aspect and a back aspect, the torso portion defining a neck opening, a waist opening, a first sleeve opening, and a second sleeve opening;

a pocket located on an inner-facing surface of the back aspect of the torso portion, the pocket extending across a vertical midline of the back aspect of the torso portion;

a first sleeve having a proximal end and a distal end, a first portion of the proximal end of the first sleeve permanently affixed to the torso portion adjacent to the first sleeve opening and a second portion of the proximal end of the first sleeve unaffixed from the first sleeve opening; and a second sleeve having a proximal end and a distal end, a first portion of the proximal end of the second sleeve permanently affixed to the torso portion adjacent to the second sleeve opening and a second portion of the proximal end of the second sleeve unaffixed from the second sleeve opening, both of the first sleeve and the second sleeve stowed within the pocket.

Clause 2. The convertible vest and jacket system of clause 1, wherein the pocket is located on an upper portion of the back aspect of the torso portion.

Clause 3. The convertible vest and jacket system of any of the preceding clauses, wherein the pocket comprises a first pocket opening located on a first lateral side of the pocket, and wherein the pocket comprises a second pocket opening located on a second lateral side of the pocket.

Clause 4. The convertible vest and jacket system of any of the preceding clauses, wherein at least a portion of the pocket is formed from a mesh material.

Clause 5. The convertible vest and jacket system of any of the preceding clauses, wherein the first portion of the proximal end of each of the first sleeve and the second sleeve comprises a posterior portion of the proximal end of each of the first sleeve and the second sleeve.

Clause 6. The convertible vest and jacket system of any of the preceding clauses, wherein the second portion of the proximal end of each of the first sleeve and the second sleeve comprises an anterior portion of the proximal end of each of the first sleeve and the second sleeve.

Clause 7. The convertible vest and jacket system of any of the preceding clauses, wherein the anterior portion of the proximal end of each of the first sleeve and the second sleeve comprises a releasable fastener.

Clause 8. The convertible vest and jacket system of any of the preceding clauses, wherein the torso portion comprises a releasable fastener located adjacent to an anterior edge of each of the first sleeve opening and the second sleeve opening, the releasable fastener located adjacent to the anterior edge of each of the first sleeve opening and the second sleeve opening complementary to the releasable fastener located at the anterior portion of the proximal end of each of the first sleeve and the second sleeve.

Clause 9. The convertible vest and jacket system of any of the preceding clauses, wherein the releasable fastener located adjacent to the anterior edge of each of the first sleeve opening and the second sleeve opening is located on an inner-facing surface of the torso portion.

Clause 10. The convertible vest and jacket system of any of the preceding clauses, wherein in a second jacket state:

each of the first sleeve and the second sleeve extend through the first sleeve opening and the second sleeve opening respectively; and the releasable fastener located at the anterior portion of the proximal end of each of the first sleeve and the second sleeve is releasably mated with the releasable fastener located adjacent to the anterior edge of each of the first sleeve opening and the second sleeve opening respectively.

Clause 11. A convertible vest and jacket system comprising:

a torso portion having a front aspect and a back aspect, the torso portion defining a neck opening, a waist opening, a first sleeve opening, and a second sleeve opening, each of the first sleeve opening and the second sleeve opening comprising an anterior edge and a posterior edge, each of the first sleeve opening and the second sleeve opening comprising a releasable fastener located adjacent to the anterior edge of each of the first sleeve opening and the second sleeve opening;

a pocket located on an inner-facing surface of the back aspect of the torso portion;

a first sleeve having a proximal end and a distal end, a posterior portion of the proximal end of the first sleeve permanently affixed to the torso portion adjacent to the posterior edge of the first sleeve opening, an anterior portion of the proximal end of the first sleeve comprising a releasable fastener complementary to the releasable fastener located adjacent the anterior edge of the first sleeve opening; and a second sleeve having a proximal end and a distal end, a posterior portion of the proximal end of the second sleeve permanently affixed to the torso portion adjacent to the posterior edge of the second sleeve opening, an anterior portion of the proximal end of the second sleeve comprising a releasable fastener complementary to the releasable fastener located adjacent the anterior edge of the second sleeve opening.

Clause 12. The convertible vest and jacket system of clause 11, wherein the releasable fastener located adjacent to the anterior edge of each of the first sleeve opening and the second sleeve opening is located on an inner-facing surface of the torso portion.

Clause 13. The convertible vest and jacket system of any of clauses 11 through 12, wherein the pocket extends across a vertical midline of the back aspect of the torso portion.

Clause 14. The convertible vest and jacket system of any of clauses 11 through 13, wherein the pocket comprises a first pocket opening located at a first lateral side of the pocket, and wherein the pocket comprises a second pocket opening located at a second lateral side of the pocket.

Clause 15. The convertible vest and jacket system of any of clauses 11 through 14, wherein the pocket is useable to stow the first sleeve and the second sleeve when the convertible vest and jacket system is in a first vest state.

Clause 16. The convertible vest and jacket system of any of clauses 11 through 15, wherein the releasable fastener located adjacent to the anterior edge of each of the first sleeve opening and the second sleeve opening comprises a male component of a snap system, and wherein the releasable fastener located at the anterior portion of the proximal end of each of the first sleeve and the second sleeve comprises a female component of the snap system.

Clause 17. The convertible vest and jacket system of any of clauses 11 through 15, wherein the releasable fastener located adjacent to the anterior edge of each of the first sleeve opening and the second sleeve opening comprises a female component of a snap system, and wherein the releasable fastener located at the anterior portion of the proximal end of each of the first sleeve and the second sleeve comprises a male component of the snap system.

Clause 18. A method of using a convertible vest and jacket system, the method comprising:

providing a vest comprising:

a torso portion having a front aspect and a back aspect, the torso portion defining a neck opening, a waist opening, a first sleeve opening, and a second sleeve opening, a pocket located on an inner-facing surface of the back aspect of the torso portion, a first sleeve having a proximal end and a distal end, a first portion of the proximal end of the first sleeve permanently affixed to the torso portion adjacent to the first sleeve opening, a second portion of the proximal end of the first sleeve unaffixed from the first sleeve opening, and a second sleeve having a proximal end and a distal end, a first portion of the proximal end of the second sleeve permanently affixed to the torso portion adjacent to the second sleeve opening, a second portion of the proximal end of the second sleeve unaffixed from the second sleeve opening, wherein both the first sleeve and the second sleeve are stowed within the pocket;

removing the first sleeve and the second sleeve from the pocket;

inserting the distal end of each of the first sleeve and the second sleeve through the first sleeve opening and the second sleeve opening respectively; and releasably affixing the second portion of the proximal end of each of the first sleeve and the second sleeve to the first sleeve opening and the second sleeve opening respectively to form a jacket.

Clause 19. The method of using the convertible vest and jacket system of clause 18, wherein the pocket includes a first pocket opening on a first lateral side of the pocket, and wherein the pocket includes a second pocket opening on a second lateral side of the pocket.

Clause 20. The method of using the convertible vest and jacket system of any of clauses 18 through 19, wherein the first pocket opening of the pocket is located adjacent and medial to the first sleeve opening, and wherein the second pocket opening of the pocket is located adjacent and medial to the second sleeve opening.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A convertible vest and jacket system comprising:

in a first vest state:

a torso portion having a front aspect and a back aspect, the torso portion defining a neck opening, a waist opening, a first sleeve opening, and a second sleeve opening;

a pocket located on an inner-facing surface of the back aspect of the torso portion and extending across a vertical midline of the back aspect of the torso portion, wherein the vertical midline extends from an approximate center of the neck opening to an approximate center of the waist opening, the pocket including an upper margin positioned adjacent the neck opening and a bottom margin positioned approximately halfway between the neck opening and the waist opening, the pocket including a first pocket opening located at a first lateral side of the pocket and a second pocket opening located at a second lateral side of the pocket;

a first sleeve having a proximal end and a distal end, a first portion of the proximal end of the first sleeve permanently affixed to the torso portion adjacent to the first sleeve opening, and a second portion of the proximal end of the first sleeve unaffixed from the first sleeve opening; and a second sleeve having a proximal end and a distal end, a first portion of the proximal end of the second sleeve permanently affixed to the torso portion adjacent to the second sleeve opening and a second portion of the proximal end of the second sleeve unaffixed from the second sleeve opening, both of the first sleeve and the second sleeve stowed within the pocket.

2. The convertible vest and jacket system of claim 1, wherein at least a portion of the pocket is formed from a mesh material.

3. The convertible vest and jacket system of claim 1, wherein the first portion of the proximal end of each of the first sleeve and the second sleeve comprises a posterior portion of the each of the first sleeve and the second sleeve.

4. The convertible vest and jacket system of claim 3, wherein the second portion of the proximal end of the each of the first sleeve and the second sleeve comprises an anterior portion of the each of the first sleeve and the second sleeve.

5. The convertible vest and jacket system of claim 4, wherein the anterior portion of the each of the first sleeve and the second sleeve comprises a releasable fastener.

6. The convertible vest and jacket system of claim 5, wherein the torso portion comprises a releasable fastener located adjacent to an anterior edge of each of the first sleeve opening and the second sleeve opening, the releasable fastener located adjacent to the anterior edge of the each of the first sleeve opening and the second sleeve opening complementary to the releasable fastener located at the anterior portion of the proximal end of the each of the first sleeve and the second sleeve.

7. The convertible vest and jacket system of claim 6, wherein the releasable fastener located adjacent to the anterior edge of the each of the first sleeve opening and the second sleeve opening is located on the inner-facing surface of the torso portion.

8. The convertible vest and jacket system of claim 7, wherein in a second jacket state:

the each of the first sleeve and the second sleeve extends through the first sleeve opening and the second sleeve opening respectively; and the releasable fastener located at the anterior portion of the proximal end of the each of the first sleeve and the second sleeve is releasably mated with the releasable fastener located adjacent to the anterior edge of the each of the first sleeve opening and the second sleeve opening respectively.

9. A convertible vest and jacket system comprising:

a torso portion having a front aspect and a back aspect, the torso portion defining a neck opening, a waist opening, a first sleeve opening, and a second sleeve opening, each of the first sleeve opening and the second sleeve opening comprising an anterior edge and a posterior edge, each of the first sleeve opening and the second sleeve opening comprising a releasable fastener located adjacent to the anterior edge of the each of the first sleeve opening and the second sleeve opening;

a pocket located on an inner-facing surface of the back aspect of the torso portion, and extending across a vertical midline of the back aspect of the torso portion, wherein the vertical midline extends from an approximate center of the neck opening to an approximate center of the waist opening, the pocket including an upper margin positioned adjacent the neck opening and a bottom margin positioned approximately halfway between the neck opening and the waist opening, the pocket including a first pocket opening located at a first lateral side of the pocket and a second pocket opening located at a second lateral side of the pocket;

a first sleeve having a proximal end and a distal end, a posterior portion of the proximal end of the first sleeve permanently affixed to the torso portion adjacent to the posterior edge of the first sleeve opening, an anterior portion of the proximal end of the first sleeve comprising a releasable fastener complementary to the releasable fastener located adjacent the anterior edge of the first sleeve opening; and a second sleeve having a proximal end and a distal end, a posterior portion of the proximal end of the second sleeve permanently affixed to the torso portion adjacent to the posterior edge of the second sleeve opening, an anterior portion of the proximal end of the second sleeve comprising a releasable fastener complementary to the releasable fastener located adjacent the anterior edge of the second sleeve opening.

10. The convertible vest and jacket system of claim 9, wherein the releasable fastener located adjacent to the anterior edge of the each of the first sleeve opening and the second sleeve opening is located on the inner-facing surface of the torso portion.

11. The convertible vest and jacket system of claim 9, wherein the pocket is useable to stow the first sleeve and the second sleeve when the convertible vest and jacket system is in a first vest state.

12. The convertible vest and jacket system of claim 9, wherein the releasable fastener located adjacent to the anterior edge of the each of the first sleeve opening and the second sleeve opening comprises a female component of a snap system, and wherein the releasable fastener located at the anterior portion of the proximal end of the each of the first sleeve and the second sleeve comprises a male component of the snap system.

13. The convertible vest and jacket system of claim 9, wherein the releasable fastener located adjacent to the anterior edge of the each of the first sleeve opening and the second sleeve opening comprises a male component of a snap system, and wherein the releasable fastener located at the anterior portion of the proximal end of the each of the first sleeve and the second sleeve comprises a female component of the snap system.

14. A method of using a convertible vest and jacket system, the method comprising:

providing a vest comprising:

a torso portion having a front aspect and a back aspect, the torso portion defining a neck opening, a waist opening, a first sleeve opening, and a second sleeve opening, a pocket located on an inner-facing surface of the back aspect of the torso portion, and extending across a vertical midline of the back aspect of the torso portion, wherein the vertical midline extends from an approximate center of the neck opening to an approximate center of the waist opening, the pocket including an upper margin positioned adjacent the neck opening and a bottom margin positioned approximately halfway between the neck opening and the waist opening, the pocket including a first pocket opening located at a first lateral side of the pocket and a second pocket opening located at a second lateral side of the pocket, a first sleeve having a proximal end and a distal end, a first portion of the proximal end of the first sleeve permanently affixed to the torso portion adjacent to the first sleeve opening, a second portion of the proximal end of the first sleeve unaffixed from the first sleeve opening, and a second sleeve having a proximal end and a distal end, a first portion of the proximal end of the second sleeve permanently affixed to the torso portion adjacent to the second sleeve opening, a second portion of the proximal end of the second sleeve unaffixed from the second sleeve opening, wherein both the first sleeve and the second sleeve are stowed within the pocket;

removing the first sleeve and the second sleeve from the pocket;

inserting the distal end of each of the first sleeve and the second sleeve through the first sleeve opening and the second sleeve opening respectively; and releasably affixing the second portion of the proximal end of the each of the first sleeve and the second sleeve to the first sleeve opening and the second sleeve opening respectively to form a jacket.

15. The method of using the convertible vest and jacket system of claim 14, wherein the first pocket opening of the pocket is located adjacent and medial to the first sleeve opening, and wherein the second pocket opening of the pocket is located adjacent and medial to the second sleeve opening.

* * * * *